United States Patent [19]

Allan

[11] Patent Number: 4,502,734

[45] Date of Patent: Mar. 5, 1985

[54] SCABBLER BITS

[76] Inventor: David T. Allan, 9 Broomhill Dr., Glasgow, Scotland

[21] Appl. No.: 391,585

[22] Filed: Jun. 23, 1982

[30] Foreign Application Priority Data

Jun. 25, 1981 [GB] United Kingdom ..... 8119658

[51] Int. Cl.[3] ..... E21B 10/00

[52] U.S. Cl. ..... 299/88; 175/413; 299/91

[58] Field of Search ..... 175/410, 411, 413, 414, 175/415, 421; 299/88, 91, 94, 37; 279/74, 75, 82, 23, 24, 89, 97, 79, 80, 86

[56] References Cited

U.S. PATENT DOCUMENTS

| | | | |
|---|---|---|---|
| 2,101,376 | 12/1937 | Voigtländer | 175/410 |
| 2,282,596 | 5/1942 | Wise et al. | 175/412 |
| 2,502,128 | 3/1950 | Curtis | 175/411 |
| 3,342,531 | 9/1967 | Krekeler | 175/413 |
| 3,658,351 | 4/1972 | Benjamin et al. | 279/89 |
| 3,726,533 | 4/1973 | Lafferty, Sr. | 279/97 |
| 4,083,415 | 4/1978 | Kita et al. | 175/415 |
| 4,146,240 | 3/1979 | Nielsen | 279/97 |
| 4,171,821 | 10/1979 | Miller | 279/75 |
| 4,190,127 | 2/1980 | Wolf | 175/410 |
| 4,202,421 | 5/1980 | Pinck | 175/415 |
| 4,222,446 | 9/1980 | Vasek | 175/413 |
| 4,225,187 | 9/1980 | Allan | 299/94 |

FOREIGN PATENT DOCUMENTS

| | | | |
|---|---|---|---|
| 1298806 | 7/1962 | France | 175/413 |
| 0084300 | 2/1951 | Norway | 175/410 |
| 0244374 | 5/1947 | Switzerland | 279/97 |

*Primary Examiner*—Stephen J. Novosad
*Assistant Examiner*—William P. Neuder
*Attorney, Agent, or Firm*—Mason, Fenwick & Lawrence

[57] ABSTRACT

There is provided an improved scabbler bit wherein the bit is fixable to a piston of a scabbling machine through a male shank portion. The shank portion carries a circumferential groove for cooperation in the side wall of the piston to hold the shank firmly within the piston. There is also provided a scabbler bit wherein the shank portion is separate from the carrier. A novel design of a scabbler tip is also disclosed together with a novel arrangement of tips on the base of a tip carrier.

7 Claims, 13 Drawing Figures

SCABBLER BITS

BACKGROUND OF THE INVENTION

This invention relates to improvements in scabbler bits.

Scabbler bits comprise a plurality of tungsten carbide tips or slugs fitted in the base of a carrier which in turn is fixed to a reciprocating piston of a scabbling machine. Scabbler bits are known in which the carrier is the form of a cylindrical member which is closed at one end to form a base, on the outer surface of which there are fitted the tungsten carbide tips. Such scabbler bits fit over a male piston and a typical example of a prior art scabbler bit is illustrated in FIG. 1*a*. The bit comprises a cylindrical female carrier 1 having a plurality of tips 2 and fixable to a male piston (not shown) by means of a fixing pin passing through holes 3, 4 in the carrier 1. Such a design of bit involves considerable machining and is not readily fitted to or removed from the piston when it is desired to change the bit.

Further, in order to present wide coverage whilst scabbling, hitherto proposed scabbler bits have employed various arrangements of, for example, five, seven and nine tips as illustrated in FIG. 1*b* to 1*d*.

Each of these arrangements suffers from a number of disadvantages one of which is that the rotating scabbler bit presents a different cutting diameter in the direction of movement of the scabbler. This results in the formation of non-uniform channels since the cutting width $W_1$ in one direction is less than the cutting width $W_2$ in another direction in each of the configurations illustrated. A second disadvantage is that a central tip is required to ensure that there does not result an uncut portion along the centre of the channel.

It is an object of the present invention to obviate or mitigate these disadvantages.

SUMMARY OF THE INVENTION

According to the present invention there is provided a scabbler bit comprising a carrier, a plurality of scabbler tips fitted to a lower surface of the carrier, the carrier having a shank portion to be received within a piston of a scabbling machine, wherein the shank portion has a circumferential groove so that the shank may be held within the piston by a fixing slug passing through an aperature in a side wall of the piston and engaging said groove.

There is further provided a scabbler bit wherein the tips are located on two pitch circles, the radii of which are different.

Preferably, the radii are such that the cutting width in the direction of movement of the scabbler bit is substantially constant irrespective of the orientation of the scabbler bit. Also, there is provided a tip for a scabbler bit, the fixing portion of which is frustoconical.

BRIEF DESCRIPTION OF THE DRAWINGS

Embodiments of the present invention will now be described, by way of example, with reference to the accompanying drawings, in which.

DESCRIPTION OF PREFERRED EMBODIMENTS

Referring to FIGS. 2 to 6 of the accompanying drawings there is illustrated a scabbler bit 80 comprising a carrier piston 81 and a male shank portion 83.

Figure 5:
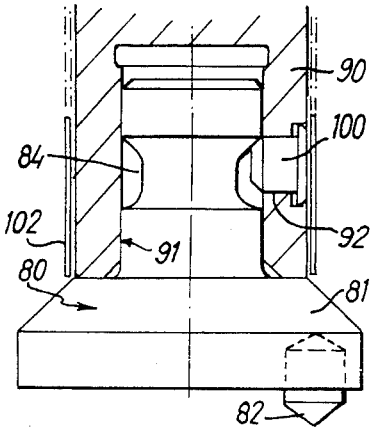
Figure 6:
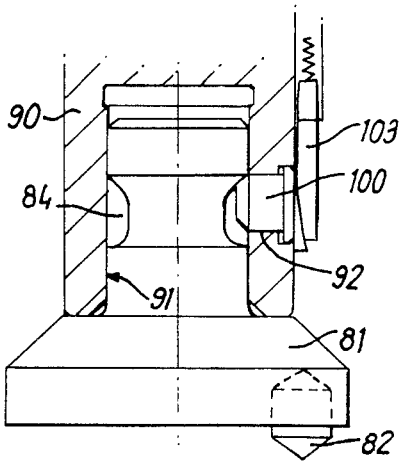

The carrier portion 81 has on its underside a number of openings 87 into which scabbler tips 82 may be fixed. The shank portion 83 has a circumferential groove 84 and in use, the shank portion is received within an opening 91 in the base of a piston 90 of a scabbling machine. The piston 90 has a radial hole 92 in its side wall which receives a fixing slug 100 which cooperates with the circumferential groove 84 in the shank portion 83 of the bit 80 such that the bit 80 is held firmly against the bottom of the piston as illustrated in FIGS. 4 to 6.

Figure 1A:
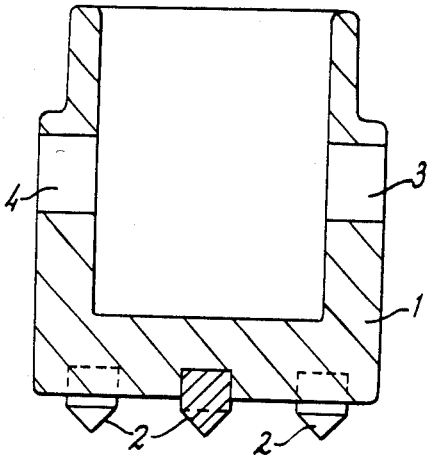
FIG. 1*a* illustrates a prior art scabbler bit.
Figure 1B:
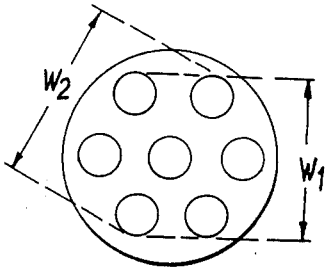
FIGS. 1*b* to 1*d* illustrate hitherto proposed arrangements of tips.
Figure 1C:
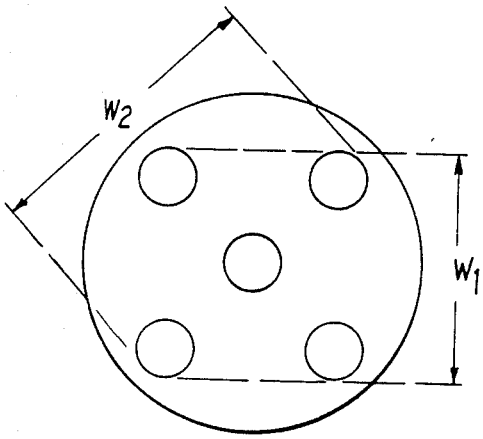
Figure 1D:
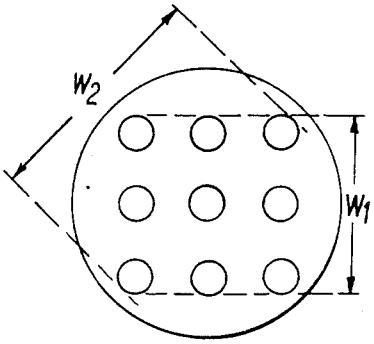
Figure 2:
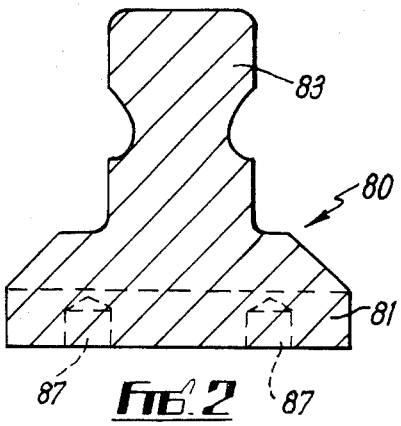
FIG. 2 is a cross-sectional elevational view of one embodiment of a scabbler bit made in accordance with the present invention.
Figure 3:
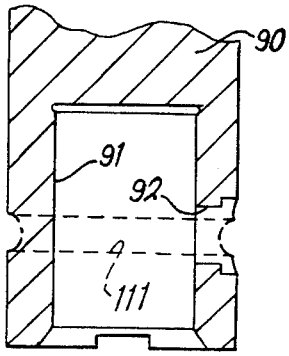
FIG. 3 is a sectional view of a part of a piston of a scabbling machine.
Figure 4:
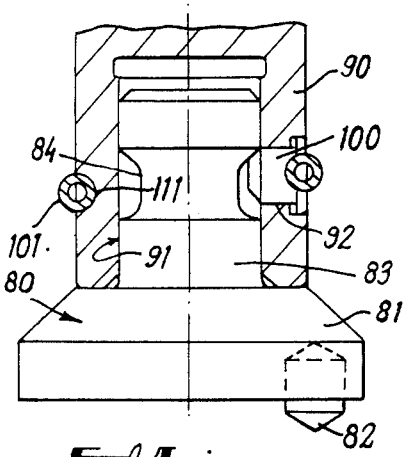
FIGS. 4 to 6 show alternative means of fixing the scabbler bit to the piston.

In FIG. 4 the slug is retained in position by a wire spring circlip 101 which locates in a circumferential groove 111 on the external surface of the piston 90. In FIG. 5 the slug is retained by a steel spring cylinder 102 which is slidable from the fixing position, as illustrated, to the release position shown in dotted lines. In FIG. 6 the slug 100 is retained by a spring urged sliding wedge 103.

Figure 7:
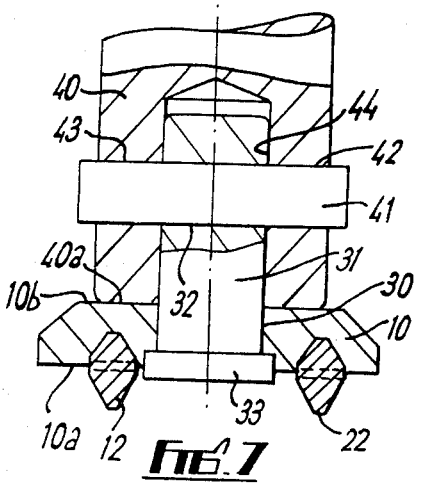
FIG. 7 is a cross-sectional view of a modified scabbler bit assembly fitted to a piston of a scabbling machine.

In FIG. 7 there is illustrated a modified novel scabbler bit assembly. The assembly comprises a carrier 10 and a separate fixing shank 31. The carrier 10 is in the form of a flat cylindrical casting or dropforging and has a central aperture 31. The lower surface 10*a* of the carrier 10 is provided with a number of openings 44 which scabbler tips 12, 22 are fixed. The fixing shank 31 has a lower flange 33 which engages the lower surface 10*a* of the carrier 10 and the shank is received in an opening 44 in a piston 40 of a scabbling machine. A radially extending through aperture 32 in the shank 31 cooperates with a pair of diametrically opposed radial through apertures 42, 43 in the side walls of the piston 40. A spring pin 41 is wedged within the apertures 32, 42 and 43 to hold the flange 33 firmly against the lower surface 10*a* of the carrier 10 and consequently to hold the upper surface 10*b* of the carrier 10 firmly against the lower surface 40*a* of the piston 40.

It will be appreciated that the above described assembly permits easy changing of the carrier 10.

Figure 8:
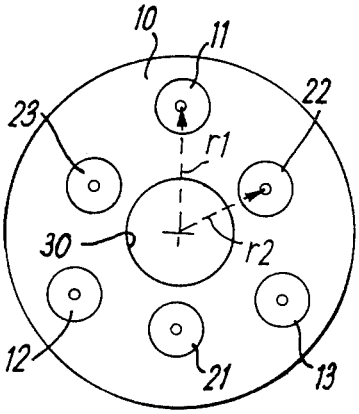
FIG. 8 is a bottom plan view of the bit carrier of FIG. 7 illustrating the novel arrangement of tips.

Referring now to FIG. 8 of the drawings, there is illustrated the underside of a scabbler bit comprising a carrier 10 having scabbler tips 11, 12, 13 and scabbler tips 21, 22, 23. The scabbler tips 11, 12, 13 are located on a circle of radius $r_1$, whereas the tips 21, 22, 23 are located on a circle of radius $r_2$, $r_2$ being smaller than $r_1$ the radii $r_1$ and $r_2$ are measured from the centre of the scabbler bit to the centre of the scabbler tips 11, 12, 13 and 21, 22 and 23 respectively. The relative values of $r_1$ and $r_2$ are such that the cutting width of the bit is substantially constant irrespective of the orientation of the bit. A ratio of $r_1$ to $r_2$ of 1.37 would ensure constant cutting width and in practice a ratio of 1.25 has been used but ratios within the range 1.05 to 1.45 would be acceptable. The arrangement illustrated reduces the occurrence of the formation of irregular channels and results in uniform scabbling.

Further, the arrangement of tips shown in FIG. 8 obviates the need for a central tip which permits the carrier to be used in the bit assembly illustrated in FIG. 7 wherein the carrier has a central hole 30 through which fits the fixing shank 31 which is fixed within the scabbler piston 40 by a spring pin 41.

Figure 9:
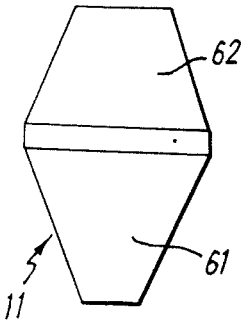
FIG. 9 is a sectional elevational view of an improved scabbler tip.
Figure 10:
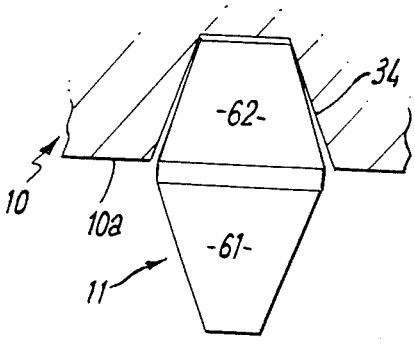
FIG. 10 illustrates the tip of FIG. 9 fitted to a carrier.

In FIGS. 9 and 10 a scabbler tip 11 has two parts, a working part 61 of conventional shape and a part 62 for fixing the tip 11 within a carrier 10. The part 62 is frustoconical and is fitted in a corresponding conical opening 44 in the lower surface 10*a* of the carrier 10.

The conical angle may be such to permit taper locking of the tip within the carrier or may be such that the tip may be fixed by capillary brazing.

Modifications and improvements may be incorporated without departing from the scope of the invention.

I claim:

1. A scabbler bit comprising a carrier in the form of a flat cylindrical member having a plurality of scabbler tips fitted to a lower surface, the carrier having a central aperture through which a separate fixing shank passes, the shank having a flange portion for engaging the lower surface of the carrier and having radially extending through apertures adapted to receive fixing means which cooperate with apertures in a piston thus to locate the carrier firmly against the lower surface of the piston whilst permitting rotation of the carrier relative to the piston.

2. A scabbler bit as claimed in claim 1 wherein said fixing means comprises a spring pin passing through diametrically opposed radial through apertures in the side walls of the piston and through said radially extending aperture in the shank.

3. A scabbler bit having a carrier, and a plurality of scabbler tips fitted to the lower surface of the carrier, the axes of the scabbler tips being parallel to the axis of the bit, the tips being located on two pitch circles, the radii of which are different, wherein the ratio of the radii is such that the cutting width in the direction of movement of the scabbler bit is substantially constant irrespective of the orientation of the scabbler bit with respect to said direction of movement.

4. A scabbler bit as claimed in claim 3 wherein the ratio of the radii is within the range 1.05 to 1.45.

5. A scabbler bit as claimed in claim 4 wherein the ratio is 1.25.

6. A scabbler bit as claimed in claim 4 wherein the ratio is 1.37.

7. A scabbler bit comprising a carrier, a plurality of scabbler tips fitted to a lower surface of the carrier, the carrier having a shank portion to be received within a piston of a scabbling machine, wherein the shank portion has a circumferential groove so that the shank may be held within the piston by a fixing slug passing through an aperture in a side wall of the piston and engaging said groove, wherein the fixing slug is retained in the aperture by means of a spring steel circlip located in a circumferential groove formed on the outer surface of the piston.

* * * * *